US006216858B1

(12) United States Patent
Chiu

(10) Patent No.: US 6,216,858 B1
(45) Date of Patent: Apr. 17, 2001

(54) TOOLBOX

(76) Inventor: Chun Ta Chiu, 8F-2, No. 185, Fu Kuo Road, Kaohsiung (TW)

( * ) Notice: Subject to any disclaimer, the term of this patent is extended or adjusted under 35 U.S.C. 154(b) by 0 days.

(21) Appl. No.: 09/592,091

(22) Filed: Jun. 12, 2000

(51) Int. Cl.[7] ..... B65D 69/00; B65D 85/28

(52) U.S. Cl. ..... 206/234; 206/234; 206/278; 81/177.4

(58) Field of Search ..... 206/349, 372–379, 206/234; 211/69, 70.6; 81/177.4, 437–439; 224/669, 666

(56) References Cited

U.S. PATENT DOCUMENTS 4,930,628 * 6/1990 Bridges ..... 206/378
5,520,400 * 5/1996 Hung ..... 206/373
5,782,150 * 7/1998 Huang ..... 206/378
5,826,719 * 10/1998 Chen ..... 206/373
5,951,385 * 9/1999 Newhouse et al. ..... 206/372
6,050,409 * 4/2000 Delbeck et al. ..... 206/379

* cited by examiner

*Primary Examiner*—Luan K. Bui
(74) *Attorney, Agent, or Firm*—Pro-Techtor International Services

(57) ABSTRACT

An oil tank-like toolbox having a tank body and a side cover hinged to the tank body, wherein the tank body has a long storage groove diagonally extended on the inside, which receives a tool handle, a plurality of short storage grooves disposed perpendicular to the long storage groove at two opposite sides, which receive a variety of tool bits, and at least one inside storage chamber adapted for receiving washers, screws and accessories, and a connector obliquely disposed on a top side wall thereof in axial alignment with the long storage groove and adapted for the mounting of the tool handle been stored in the long storage groove, for enabling the tool handle to be turned the toolbox by hand to rotate a tool bit against a workpiece.

9 Claims, 6 Drawing Sheets

TOOLBOX

BACKGROUND OF THE INVENTION

The present invention relates to toolboxes, and more particularly to such a toolbox, which is shaped like a handy oil tank.

A variety of toolboxes have been disclosed, and have appeared on the market. Conventional toolboxes commonly have a variety of storage compartments for keeping tool parts and accessories in good order. However, these toolboxes are specifically designed for keeping tool parts and accessories only. In order to attract consumers, a toolbox should be made having a special design, or providing an added function.

SUMMARY OF THE INVENTION

It is one object of the present invention to provide a toolbox, which has the shape of an oil tank that attracts people to buy it. It is another object of the present invention to provide a toolbox, which can be used as handgrip means to hold a hand tool with a tool bit at the hand tool for turning by hand to work a workpiece. According to one aspect of the present invention, the toolbox is shaped like an oil tank, comprising a tank body and a transparent side cover hinged to the tank body. The tank body comprises a long storage groove diagonally extended on the inside, which receives a tool handle, a plurality of short storage grooves disposed perpendicular to the long storage groove at two opposite sides, which receive a variety of tool bits, and at least one inside storage chamber adapted for receiving washers, screws and accessories, and a connector obliquely disposed on a top side wall thereof in axial alignment with the long storage groove and adapted for the mounting of the tool handle been stored in the long storage groove, for enabling the tool handle to be turned the toolbox by hand to rotate a tool bit against a workpiece. According to another aspect of the present invention, a clip is provided at the back side of the tank body for fastening.

DETAILED DESCRIPTION OF THE PREFERRED EMBODIMENT

Figure 1:
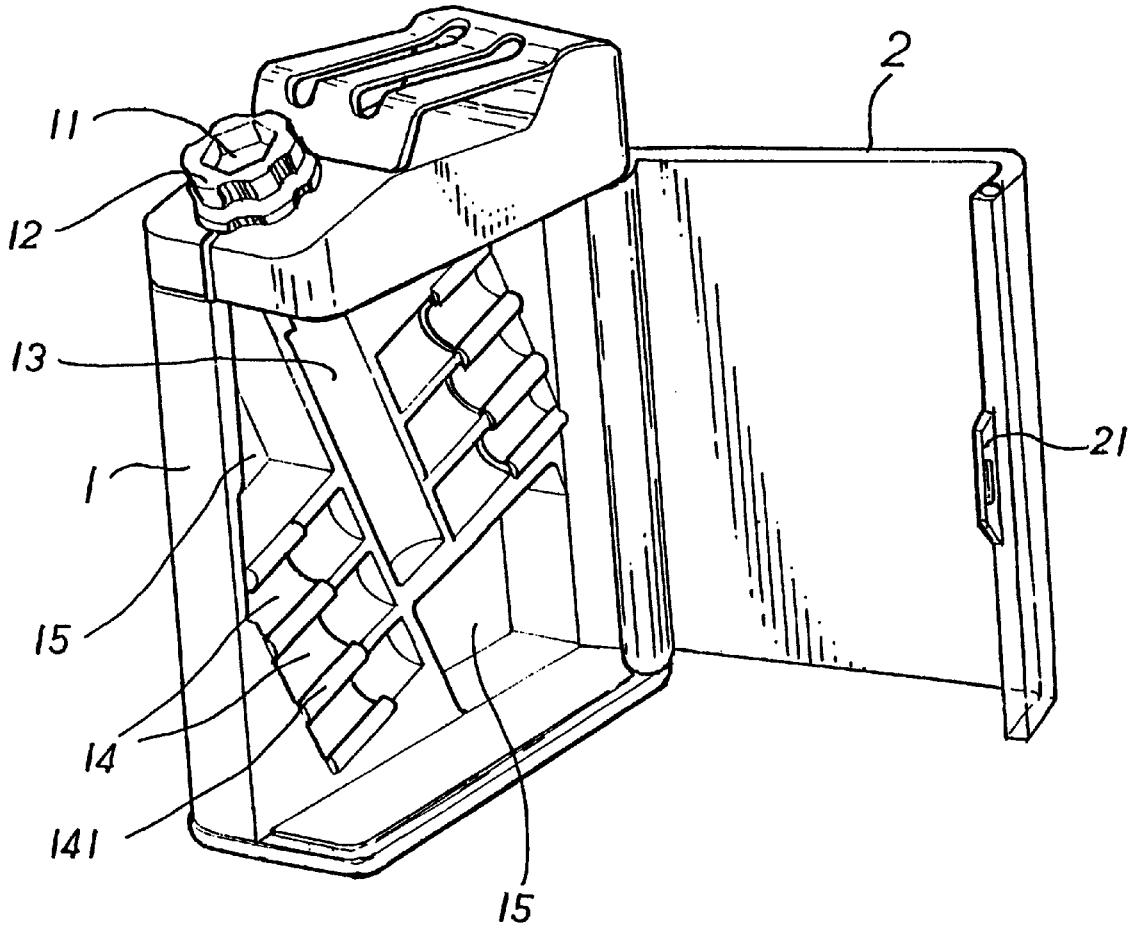
FIG. 1 is a perspective view of a toolbox according to the present invention when opened.
Figure 2:
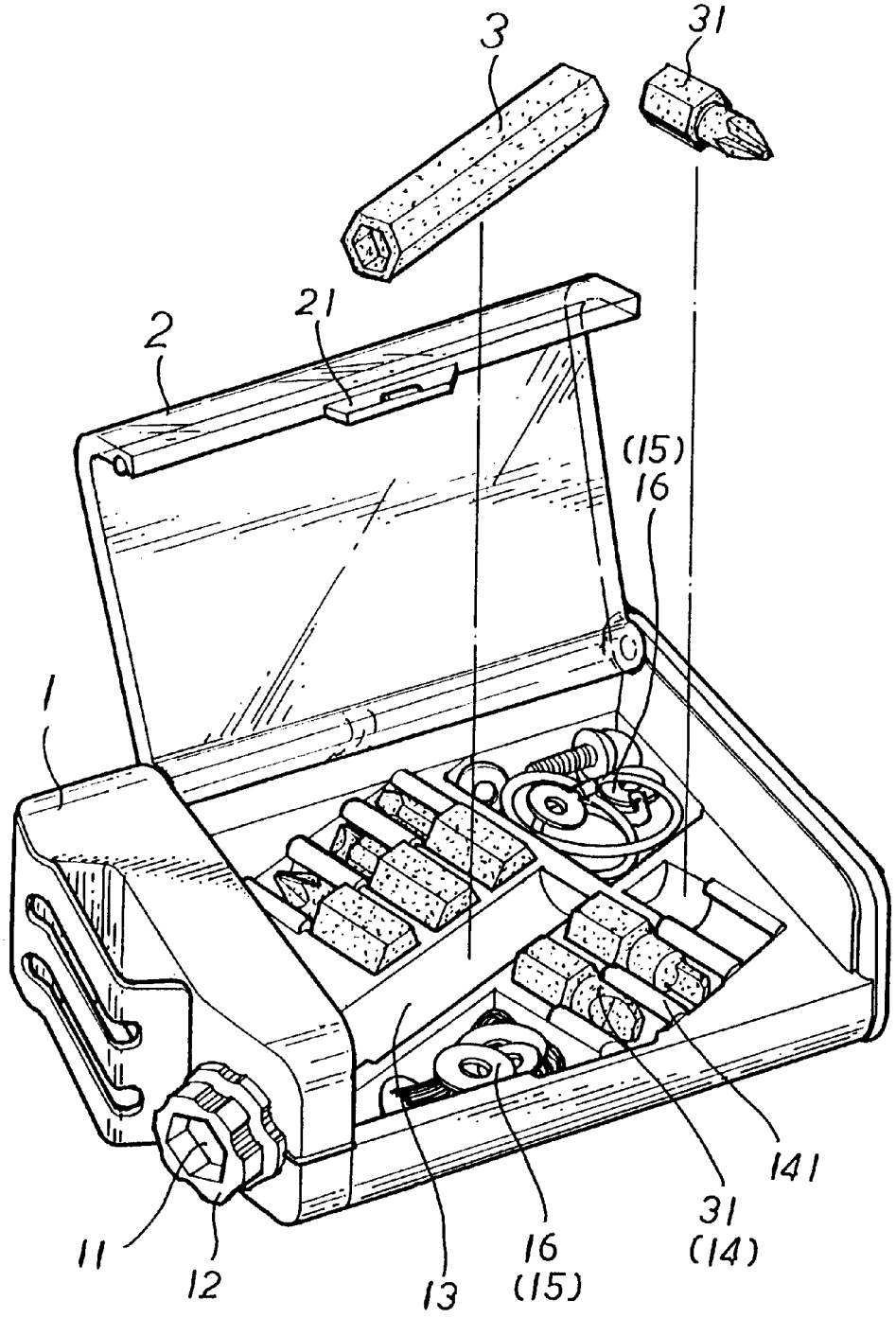
FIG. 2 shows a variety of storage items stored in the toolbox according to the present invention.
Figure 3:
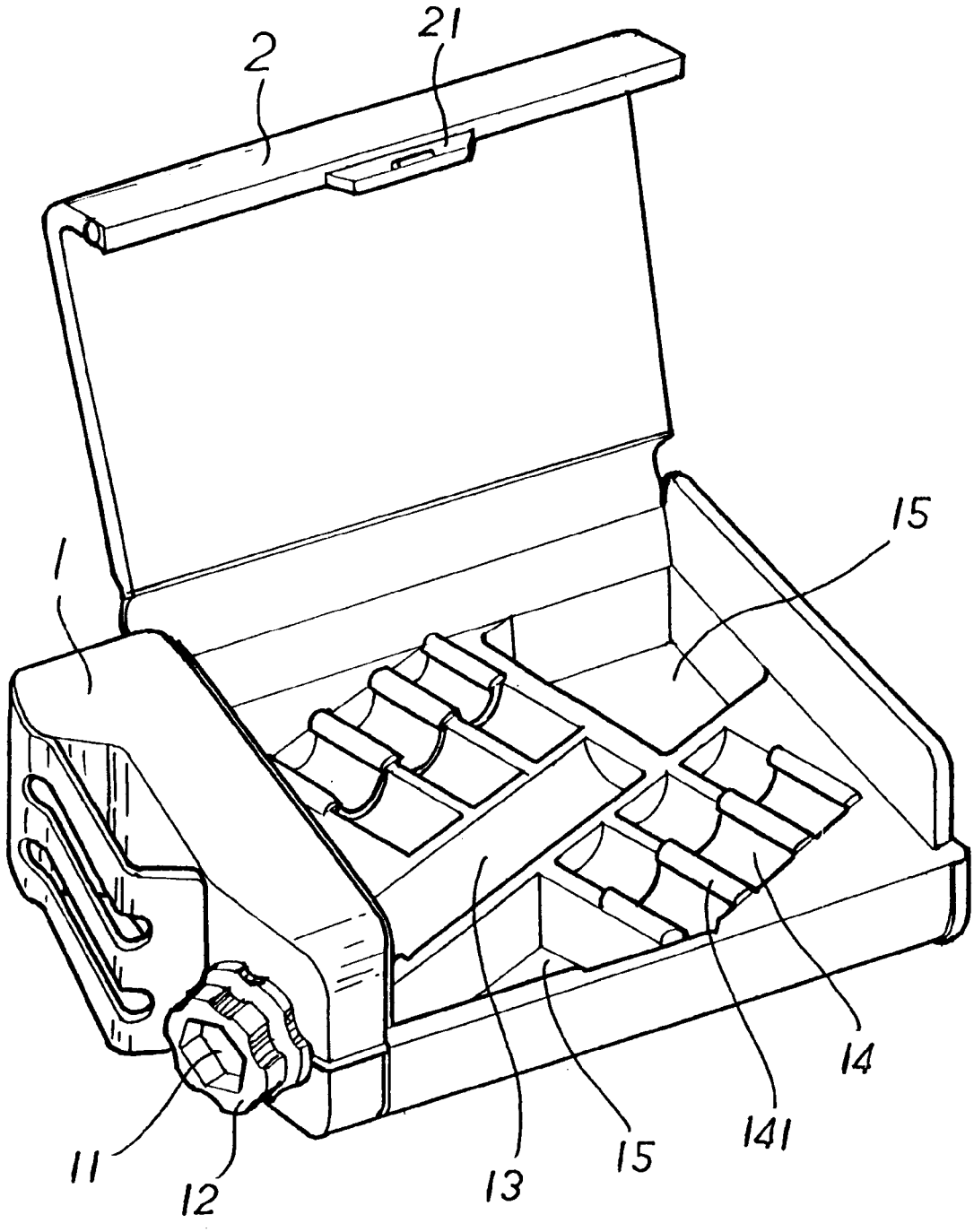
FIG. 3 illustrates an alternate form of the toolbox according to the present invention.

Referring to FIGS. 1, 2, and 3, a toolbox in accordance with the present invention is shaped like an oil tank, comprising a tank body 1 having a side cover 2. In the embodiment shown in FIG. 3, the side cover 2 is integral with the tank body 1. In the embodiment shown in FIGS. 1 and 2, the side cover 2 is separately made, and then hinged to the tank body 1. The side cover 2 has a downward retaining flange 21, which is forced into engagement with a part of the tank body 1 to hold the side cover 2 in close position. The tank body 1 comprises a long storage groove 13 diagonally extended on the inside and adapted for receiving a tool handle 3, a plurality of short storage grooves 14 disposed perpendicular to the long storage groove 13 at two opposite sides and adapted for receiving a variety of tool bits 31, and at least one, for example, two inside storage chambers 15 adapted for receiving washers, screws and accessories 16, and a connector 12 obliquely disposed on the top side wall thereof in axial alignment with the long storage groove 13. The short storage grooves 14 each comprise a protruded engagement portion 141 adapted to hold down the respective storage tool bit 31. The connector 12 defines a polygonal coupling hole 11 adapted for receiving the tool handle 3. The tool handle 3 has a polygonal cross section fitting the polygonal coupling hole 11. Further, the side cover 2 can be made transparent so that the user can observe the internal storage items in the tank body 1 through the side cover 2 when the toolbox is closed.

Figure 4:
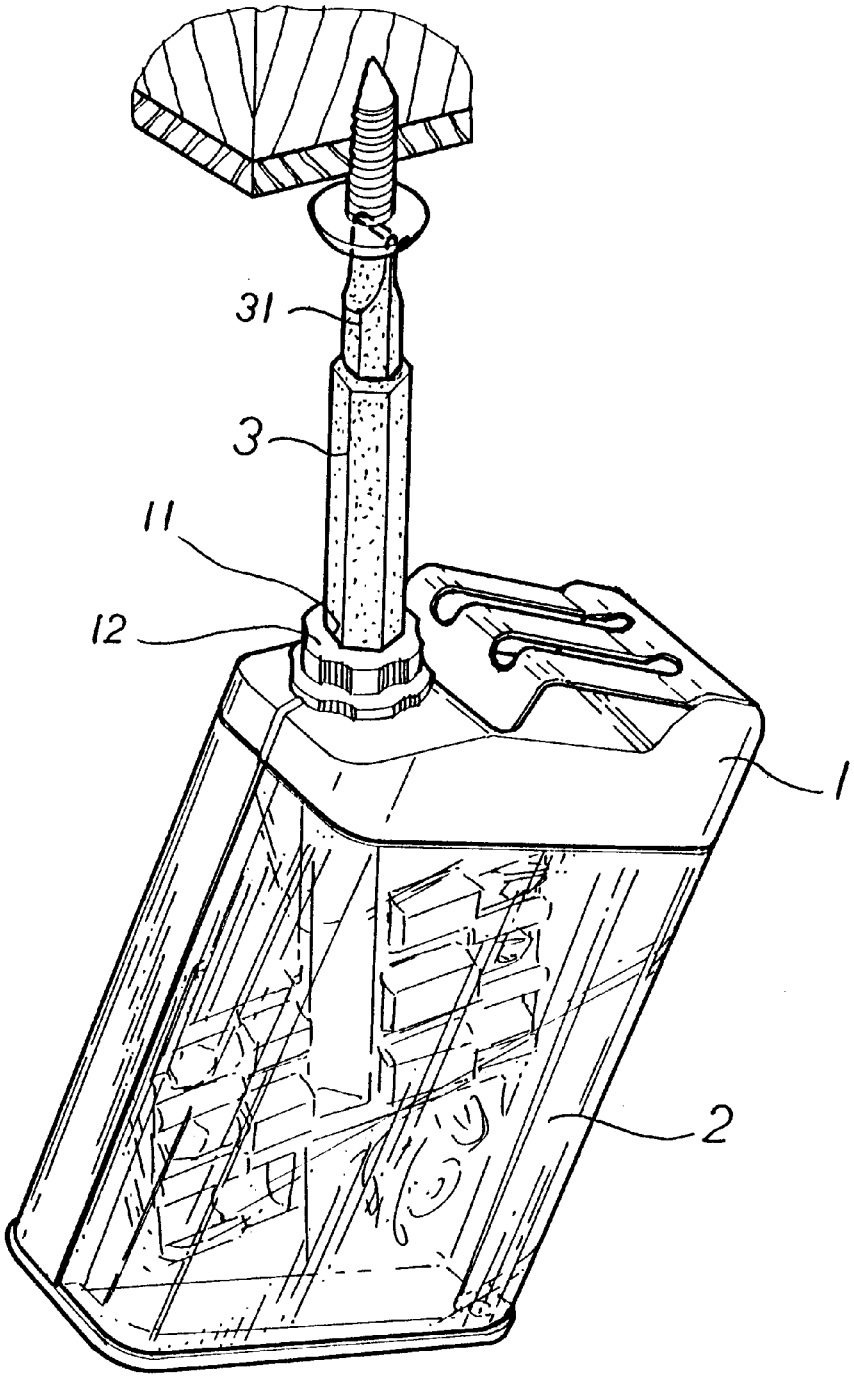
FIG. 4 illustrates an application example of the present invention.

Referring to FIG. 4 and FIG. 2 again, the tool handle 3 can be fastened to the polygonal coupling hole 11 in the connector 12 to hold one tool bit 31 for working. In this case, the toolbox serves as a handgrip for the holding of the hand to turn the tool handle 3 and the attached tool bit 31 against the workpiece.

Figure 5:
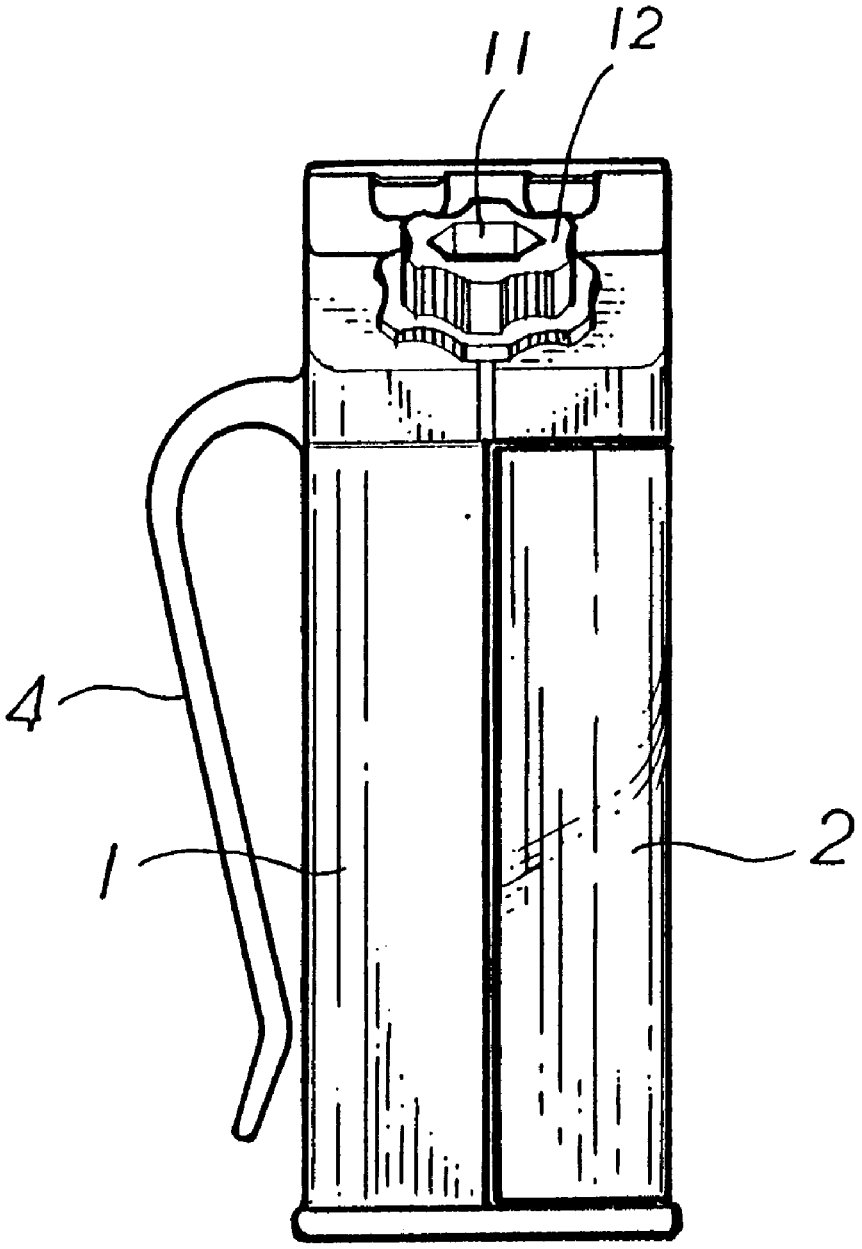
FIG. 5 is a side view of another alternate form of the present invention, showing a clip provided at the back side of the tank body of the toolbox.

Referring to FIG. 5, a clip 4 is provided at the back side wall of the tank body 1. By means of the clip 4, the toolbox can be fastened to the user's belt.

Figure 6:
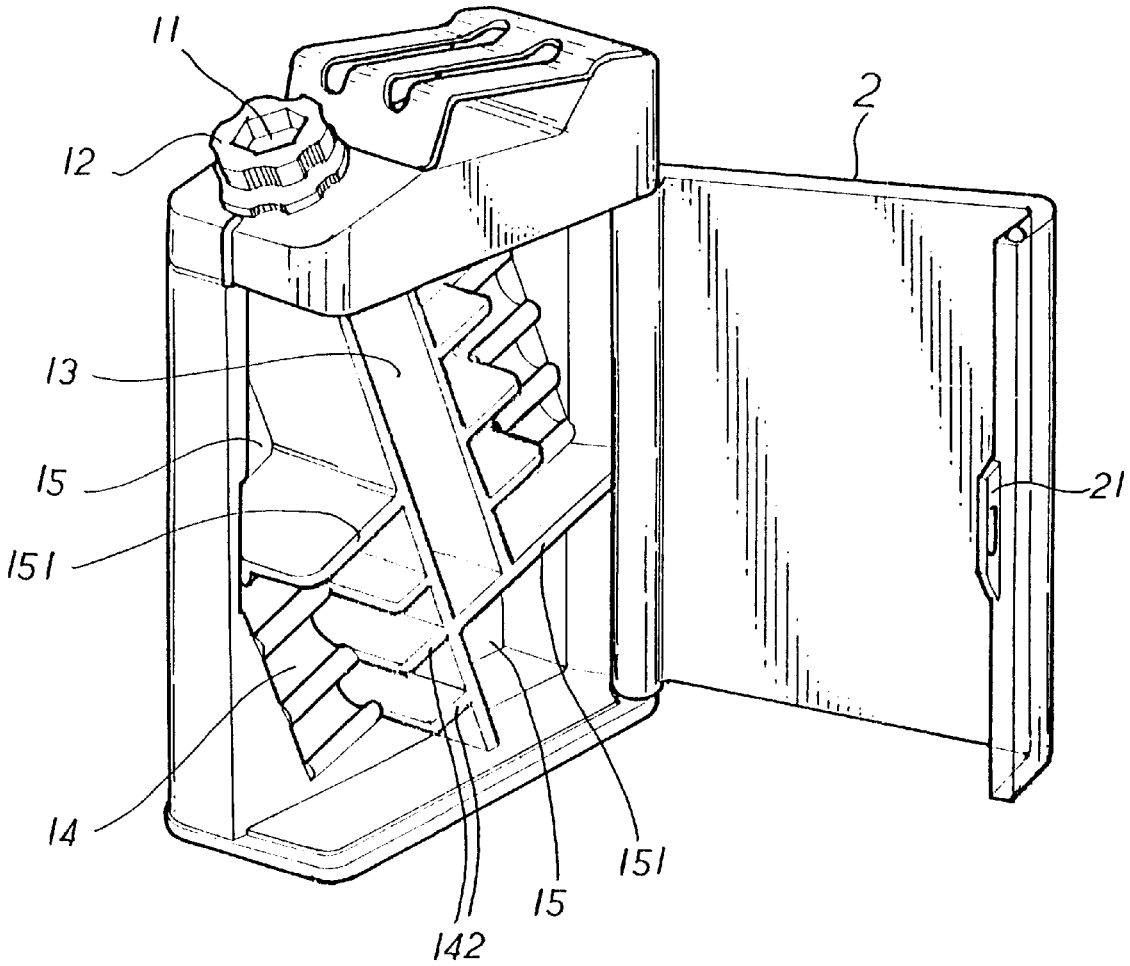
FIG. 6 is a perspective view of still another alternate form of the present invention.

Referring to FIG. 6, upright stop walls 151 and 142 are respectively provided inside the tank body 1 along the border area of the long storage groove 13, the short storage grooves 14 and the inside storage chambers 15, and adapted for stopping against the inside wall of the side cover 2 to stop storage items from escaping out of the respective long storage groove 13, short storage grooves 14 and inside storage chambers 15 when the tool box is closed.

It is to be understood that the drawings are designed for purposes of illustration only, and are not intended for use as a definition of the limits and scope of the invention disclosed.

What the invention claimed is:

1. A toolbox comprising a tank body, and a side cover covered on said tank body, said tank body comprising a long storage groove diagonally extended on the inside, which receives a tool handle, a plurality of short storage grooves disposed perpendicular to said long storage groove at two opposite sides, which receive a variety of tool bits, and at least one inside storage chamber adapted for receiving washers, screws and accessories, and a connector obliquely disposed on a top side wall thereof in axial alignment with said long storage groove and adapted for the mounting of the tool handle been stored in said long storage groove, for enabling the tool handle to be turned the toolbox by hand to rotate a tool bit against a workpiece.

2. The toolbox of claim 1 wherein said tank body comprises a back clip for fastening.

3. The toolbox of claim 1 wherein said side cover has a downward retaining flange, which is forced into engagement with a part of said tank body to hold said side cover in position when said side cover is closed on said tank body.

4. The toolbox of claim 3 wherein said side cover is integral with a part of said tank body.

5. The toolbox of claim 3 wherein said side cover is transparent, and hinged to a part of said tank body.

6. The toolbox of claim 1 wherein said connector defines a polygonal coupling hole, and said tool handle has a polygonal cross section fitting the polygonal coupling hole of said connector.

7. The toolbox of claim 1 wherein said short storage grooves each comprise a protruded engagement portion adapted to hold down the respective storage tool bit.

8. The toolbox of claim 1 wherein said at least one storage chamber each has an upright peripheral stop flange, which is stopped against an inside wall of said side cover to stop the respective storage items from escaping out of place when said side cover is closed on said tank body.

9. The toolbox of claim 1 wherein said short storage grooves each have an upright peripheral stop flange, which is stopped against an inside wall of said side cover to stop the respective storage item from escaping out of place when said side cover is closed on said tank body.

* * * * *